US006552781B1

(12) United States Patent
Rompel et al.

(10) Patent No.: US 6,552,781 B1
(45) Date of Patent: Apr. 22, 2003

(54) DEVICE FOR COUNTING AND/OR SORTING COINS

(75) Inventors: Wolfgang Rompel, Berlin (DE); Jürgen Redeker, Berlin (DE); Thomas Zimmermann, Berlin (DE)

(73) Assignee: F. Zimmermann GmbH & Co. KG (DE)

( * ) Notice: Subject to any disclaimer, the term of this patent is extended or adjusted under 35 U.S.C. 154(b) by 205 days.

(21) Appl. No.: 09/696,211

(22) Filed: Oct. 25, 2000

(30) Foreign Application Priority Data

Oct. 26, 1999 (DE) ..... 199 51 458
Jun. 16, 2000 (DE) ..... 100 28 934

(51) Int. Cl.[7] ..... G07D 3/16
(52) U.S. Cl. ..... 356/71; 250/336.1
(58) Field of Search ..... 356/71, 51, 237.1; 250/336.1, 559.44

(56) References Cited

U.S. PATENT DOCUMENTS 5,542,520 A 8/1996 Beisel et al.

FOREIGN PATENT DOCUMENTS

DE 25 47 685 10/1975
DE PCT/IB97/00569 5/1997
EP 0 629 979 12/1994
EP 0667973 B1 * 8/1995 ..... 356/71
GB 1 605 266 2/1987

* cited by examiner

*Primary Examiner*—Georgia Epps
*Assistant Examiner*—Richard Hanig
(74) *Attorney, Agent, or Firm*—McGlew and Tuttle, P.C.

(57) ABSTRACT

A device for counting and/or sorting coins (1) being fed in an regular sequence on a guiding track (4), with their borders (2) resting against a guiding edge (3), with a coin identification unit (5). The identification unit includes an optical device for the determination of coin diameters (d). The optical device has a light source (6) and light-sensitive sensor (7) opposite to coin (1), with respect to a main coin face. The sensor transforms irradiated light into electrical signals and is adapted as a CCD element (7). The light source includes an emission source (8) and optical elements (9, 10) for the generation of a light beam being directed in parallel and orthogonally to a main coin face.

The lateral extension of the light beam and the arrangement of CCD element (7) according to coin diameters (d) to be detected is configured such that only part of the CCD element (7) can be shaded by a coin (1) to be detected.

20 Claims, 3 Drawing Sheets

DEVICE FOR COUNTING AND/OR SORTING COINS

FIELD OF THE INVENTION

The invention relates to a device for counting and/or sorting coins being fed in an irregular sequence on a guiding track, with borders of the coins resting against a guiding edge, with a coin identification unit comprising an optical device for the determination of coin diameters, the optical device comprising a light source and light-sensitive sensor opposite to the coin, with respect to a main coin face, this sensor transforming irradiated light into electrical signals.

BACKGROUND OF THE INVENTION

A device of the type mentioned above is known in the art for example from document DE-2547685 C2. In this known device, lighting of the coin is performed by one or several diffuse light sources. On the side opposite to the main face of the coin a sensor is provided comprising a plurality of light guiding fibers. The fibers are generally disposed along a line extending orthogonally to the feeding direction. The light guiding fibers are respectively optically connected to a photo-electric cell. When a coin passes the line of the light guiding fibers, it covers and shades a certain maximum number of light guiding fibers. From the shaded light guiding fiber(s) thus the information can be obtained that the passing coin has a diameter size between the distance of the outermost shaded light guiding fiber to the guiding edge and the distance of the innermost not shaded light guiding fiber to the guiding edge.

In practical applications, the known device has proven excellent. However, it can be improved in terms of cost. On one hand, the manufacture of a holder for light guiding fibers with a plurality of light guiding fibers precisely to be positioned is expensive. Further, such a device cannot easily be used for counting different currencies. This is caused by the fact that basically not a diameter is determined, but rather a diameter range is determined. Different currencies have however different coins of various diameters, so that usually with one holder for light guiding fibers at most two or three currencies can be covered, since for each individual "allowed" diameter one or two assigned light guiding fibers have to be provided.

SUMMARY AND OBJECTS OF THE INVENTION

It is the object of the invention to provide a device for counting and/or sorting coins that is less expensive and is nevertheless suitable for a plurality of currencies without changing structural parts.

For achieving this object, the invention provides a device for counting and/or sorting coins being fed in an irregular sequence on a guiding track, with their borders resting against a guiding edge, with a coin identification unit comprising an optical device for the determination of coin diameters, the optical device comprising a light source and a light-sensitive sensor opposite to the coin, with respect to a main coin face, the sensor transforming irradiated light into electrical signals and including a CCD element. The light source includes an emission source and optical elements for the generation of a light beam being directed in parallel and orthogonally to a main coin face. The lateral extension of the light beam and the arrangement of the CCD element according to coin diameters to be detected being configured such that part only of the CCD element can be shaded by a coin to be detected. As a CCD element, within the framework of the invention, every opto-electronic element is designated which comprises a plurality of independent light-sensitive pixels to be individually read out in an electronic manner. The pixels can be arranged in one dimension (straight or curved) or in two dimensions (plane or curved in one or two dimensions).

By using a CCD element, a very high resolution can easily be achieved, for instance 15 pixels or "dots" per mm.

With this insofar comparatively very high resolution, basically also diameter ranges only and not precise diameter sizes are determined; these reduced diameter ranges are however so small, in a measurement, that they can practically be assigned to a discrete diameter size. As a result, generally the diameter of any coin can be determined with one and the same CCD element. Therefore, different currencies can be processed after just supplementing or replacing the associated evaluation software. The high precision obtained by the invention in the detection of diameters is however not only based on the CCD element. Rather, it is equally important that, in contrast to prior art, lighting of the coin is performed with a parallel light beam. Diffuse light would lead to "soft" transitions in the shades in the area of the coin borders, due to the extension of the coin in the direction orthogonal to the main coin face.

Structurally particularly simple and cost effective to make is an embodiment of the invention, wherein the emission source is adapted as an l.e.d., preferably emitting in the wavelength range 640 to 980 nm. In particular it is possible to use an emission source emitting in the i.r. range.

A parallel light beam can for instance be obtained by that the light source is in the focus of a parabolic mirror or is imaged into the focus of the parabolic mirror by another optical device.

Interfering shades and/or emissions by the emission source can be avoided with the curvature of the parabolic mirror corresponding to a segment of a parabola leg, i.e. does not include the base point.

Generally, the invention can work in different ways. In a comparatively expensive embodiment, the CCD element is a CCD area element, i.e. extending in both spatial dimensions of a plane parallel to a main coin surface. In this embodiment, a single readout of the CCD area element provides find of a photography of a coin border contour segment, the evaluation software then calculating the coin diameter in a precision being, with suitable algorithms, even better than the resolution of the CCD area element. In such an embodiment, the parabolic mirror would have to have a doubly curved surface, i.e. be a surface segment of a paraboloid of revolution. Corresponding considerations apply in the case of an optical convergent lens, as described below. In this embodiment, even special coin borders differing from the circular shape can be detected, and such special shapes can be used as an additional parameter in the sorting function (in addition to the "diameter").

In a simple embodiment compared thereto, however fully satisfying in practical applications, the CCD element is a CCD line disposed orthogonally with respect to the feeding direction, the extension line of the CCD line being located in a surface parallel to a main coin face. The parabolic mirror can then be configured as a singly parabolically curved surface having, with respect to the curvature, a lateral extension of less than 10 mm, preferably less than 5 mm, most preferably less than 3 mm, and forming a directed light line of respective width, corresponding to the extension of the CCD line.

Alternatively to the utilization of a parabolic mirror, the light source can be located in the focus of a convergent lens or be imaged into the focus of the convergent lens. Mirrors are here not necessary.

The optical convergent lens can then be configured with singly curved surfaces, e.g. cylindrical or bar-type, having an extension in the direction orthogonal to the optical axis and orthogonal to the curvature of less than 10 mm, preferably less than 5 mm, most preferably less than 3 mm, and forming a directed light line of respective width, corresponding to the extension of the CCD line.

As an optical convergent lens is designated a lens the focal length of which in an optically thinner medium is larger than 0. A convergent lens may be configured symmetrical or asymmetrical-biconvex, planoconvex or concavoconvex. The lens surfaces may be spherical or aspherical. If the optical convergent tens is only provided with singly curved surfaces, i.e. is a bar lens, it has no focal point, but a focal line. Besides that, the above will also apply. The term optical convergent lens does not only include individual lenses, but also lens systems behaving as a convergent lens, that is have a focal length in an optical thinner medium of larger than 0. Thus, in such a lens system, divergent lenses can also be provided. For the design and configuration of the optical convergent lens or of a corresponding lens system, the principles of geometrical optics will apply, such principles being well known to the man skilled in the art. The optical convergent lens can be made of any usual transparent material, in particular glass and/or plastic. Preferred, however, is a configuration as a plastic lens. The lens surfaces may be coated, for instance is order to reduce interfering reflections.

In the embodiment described above comprising a CCD line, the light can further be made narrow, if a bar lens disposed in parallel to the light line is provided in the area of a light exit opening of the light source. Optimum results are obtained, if the focus of the bar lens is located approximately in the area of a middle plane between the two main coin surfaces. It is also possible, however, to have the focus of the bar lens in the area of the CCD element. Thus, the (parallel) light beam is focused in a plane defined by the feeding direction and the optical axis of the light beam. In a plane extending orthogonally hereto and in parallel to the optical axis of the light beam, parallelism is however maintained. By the thus achievable narrowing of the light line, border effects during passage of the coins can be reduced.

The device according to the invention can be improved in various ways. It is for instance possible to provide in the immediate area of the CCD element, for instance immediately in front, with regard to the feeding direction, a stopping element for blocking the coin sequence, the stopping element being adapted as a locking pin driven by a bi-stable magnet, which clears the guiding track in one position of the magnet and blocks it in the other position of the magnet. Further, a deflection element can be provided behind the coin identification unit fur sorting-out coins of diameters different from the given diameter size, the deflection element being driven by means of a bistable magnet. Such deflection elements are known in the art in connection with a throw-out opening, and insofar reference is made to such prior art.

The utilization of bi-stable magnets as described above has the advantage that compared to mono-stable magnets with reset spring, comparatively small electrical energies are required for operation. Further, the response times are short and independent from any aging processes of the spring elements.

The locking pin generally can be bar-type, with a main axis being orthogonal to the guiding track. Operation by the magnet is then made such that the pin is moved in the direction of its main axis; it will, however, project into the guiding track in one of its two positions only. When using a bi-stable magnet, it is further advantageous that the hold current in the blocking position practically acts as a spring. This has the consequence that a coin positioned above the activated locking pin will not be thrown out of its guiding track. Rather, it will glide over the locking pin end, and the locking pin will only swing into the guiding track, after the coin has cleared the latter. Alternatively or additionally hereto, the locking pin may comprise a spring-loaded locking element in the direction of the main axis of the locking pin causing an operation as described above.

With regard to the deflection element, it is understood that in an evaluation circuitry the time period is taken into account which exists between the detection of an undesired diameter by the optical device and the arrival of the respective coin at the deflection element. This time span is generally determined by the feeding speed and may vary correspondingly.

The invention further relates to a method for determining coin diameters, wherein coins are fed in an irregular sequence on a guiding track, with their borders resting against a guiding edge, through a coin identification unit according to the invention, wherein the CCD line at passage of an individual coin is multiply read out, wherein for every read-out process a shading degree is determined and a shading degree sequence for the individual coin is stored in a memory element, with reducing shading degree during passage of a coin the previously determined maximum shading degree being fetched from the memory element as a diameter size and being used as an input value of a sorting function. A particularly high immunity against interferences during measurement and read-out of the CCDline is possible, if the light source is switched to dark during the read-out cycle.

When using a CCD area element, however, such multiple activation of the CCD element is not necessary. Here a single "momentary lighting" is sufficient for the determi nation of the border segment and thus for the calculation of a coin diameter. It may be recommendable to operate the emission source as a pulsed source, so that the detected border contour is not kind of washed out by the feeding progress.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
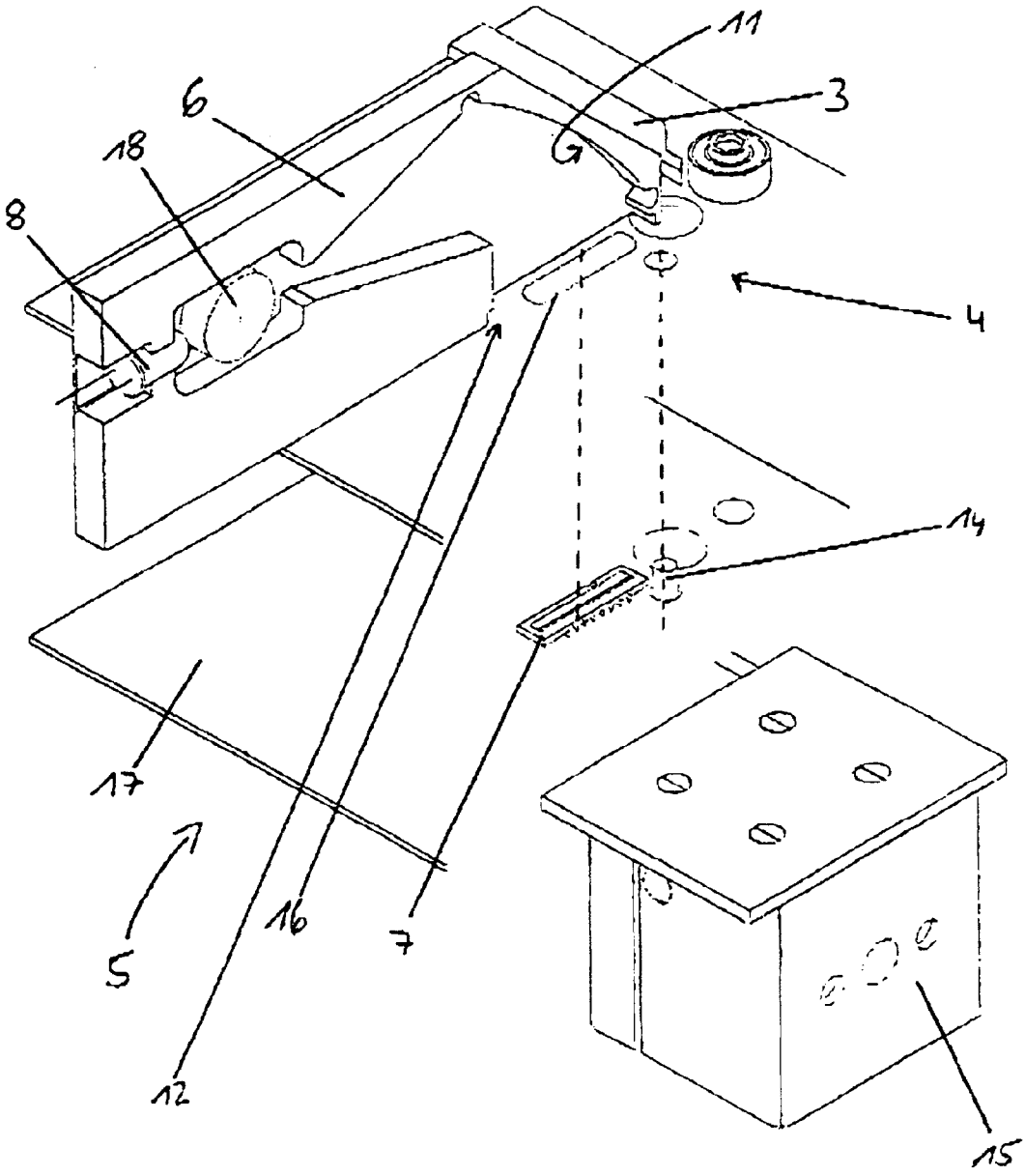
FIG. 1 a diagrammatical exploded view of a device according to the invention in the area of the optical device for determining coin diameters.
Figure 2B:
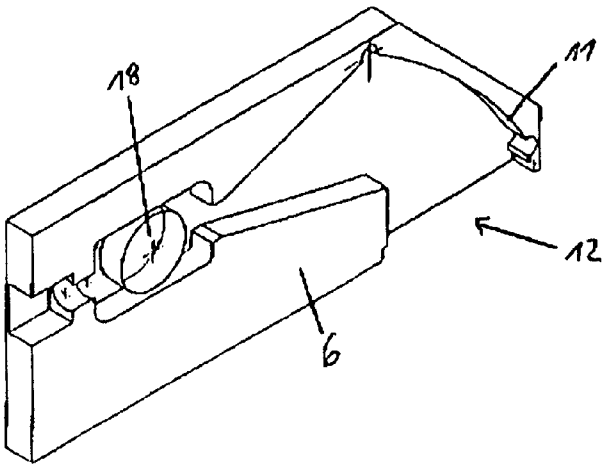
FIG. 2*b* is a perspective representation of the light source.
Figure 2A:
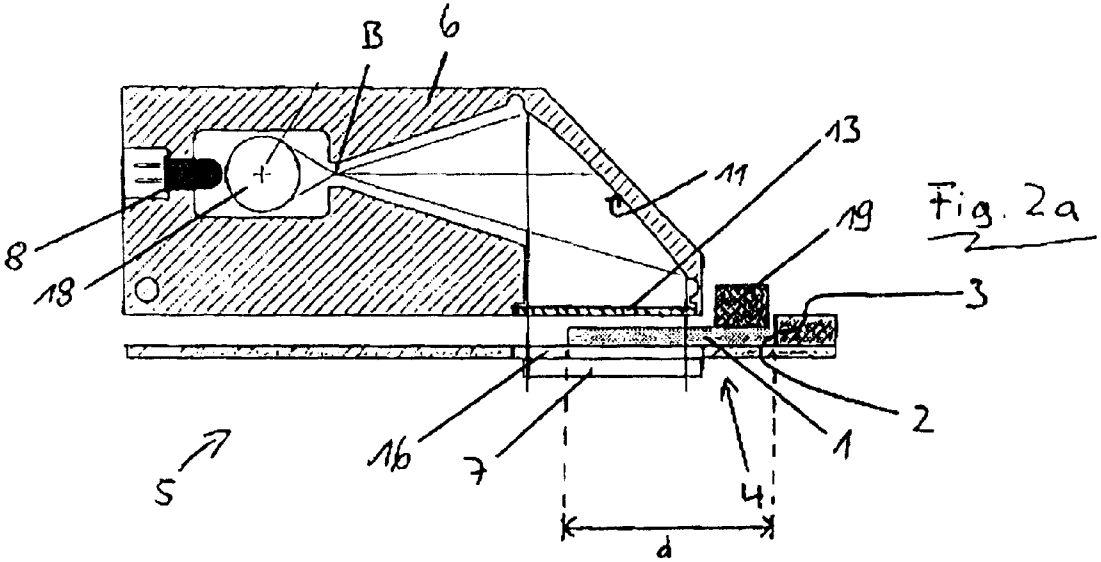
FIG. 2*a* is a cross sectional view in the area of the light source.

Referring to the drawings in particular, FIG. 1 shows a device for counting and/or sorting coins 1 being fed in an irregular sequence on a guiding track 4. The borders 2 of the coins rest against a guiding edge 3. This is achieved by means of a feeding belt 19. Reference is also made to FIG. 2*a*. A coin identification unit 5 is provided, comprising an optical device for the determination of the coin diameters d. The optical device includes a light source 6 and light-sensitive sensor 7 opposite to the coin, with respect to a main coin face. The sensor transforms irradiated light into electrical signals. Sensor 7 is, in the embodiment, a CCD line 7 disposed orthogonally to the feeding direction and the extension line of which being disposed in a surface parallel to a main coin face. CCD line 7 is located immediately below a light passage opening 16 in guiding track 4, for instance on a p.c. (printed circuit) board 17 comprising further electronic components.

Comparing FIGS. 1 and 2*a* and *b,* it will be understood that emission source 8 adapted as an LED is imaged over a cylindrical lens 18 into focus B of a parabolic mirror 11. Between cylindrical lens 18 and parabolic mirror 11, in addition an apertured disk (not shown in the drawings) can be provided, in order to minimize imaging errors caused by a not point-shaped emission source and by cylindrical lens 18. In the embodiment, parabolic mirror 11 is configured as a singly parabolically curved surface (i.e. no area segment of a hyperboloid of revolution), having a lateral extension—with regard to the curvature—of less than 5 mm, and forming a directed light line of respective width, corresponding to the extension of the CCD line. It is understood that shown light source 6 is in practical applications closed on both ends and is made black inside (with the exception of the optical elements). For the sake of better understanding, one side cover has been omitted in the figures. It can be seen that the curvature of parabolic mirror 11 corresponds to a segment of a parabola leg. The orientation of the parabolic mirror has been selected such that the optical axis of emission source 8 is generally orthogonal to the optical axis of light exit opening 12. In the area of light exit opening 12, a bar lens 13 arranged parallely to the light line can be provided, said bar lens reducing the width of the light line in the area of a coin 1 to be identified.

FIG. 1 also shows a stopping element 14 for blocking the coin sequence. This stopping element 14 is adapted as a locking pin driven by a bi-stable magnet clearing guiding track 4 in one position of magnet 15 and blocking it in the other position of magnet 15. In the shown operating condition, guiding track 4 is clear.

In the embodiments, determination of a coin diameter is achieved as follows. During the passage of a single coin 1, CCD line 7 is multiply read out. At each read-out process, a shading degree is determined. The thus generated shading degree sequence for a single coin is stored in a memory element. With decreasing shading degree in the course of this shading degree sequence during passage of a coin 1, the previously determined maximum shading degree is called off from the memory element as a diameter size d and is used as an input value of a sorting function. It is understood that the sorting function includes one or more given or adjustable stored diameter sizes, and that for instance a deflection element is activated or de-activated according to a comparison of an actually measured diameter size d to a given diameter size.

Figure 3:
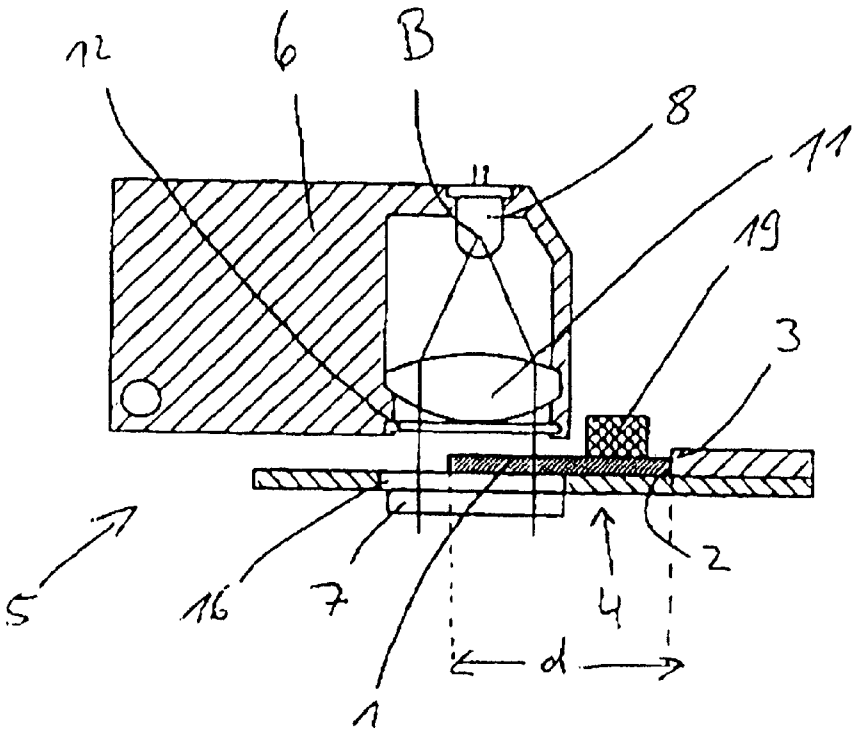
FIG. 3 is a light source as an alternative to the embodiment of FIG. 2.

FIG. 3 shows a device as generally described with reference to FIG. 1. In this embodiment, a CCD line of the type IL-CC 1024 made by Dalsa has been used. This CCD line comprises in a linear configuration 1,024 sensor elements (dots or pixels) of a density of approx. 72 dots pet mm. In deviation from the previous embodiment, it can be seen that emission source 8 adapted as an LED is located in focus B of an optical convergent lens 11. In this embodiment, optical convergent lens 11 is configured with singly curved surfaces (i.e. no area segment of a body of revolution), having a lateral extension—with regard to the curvature—of less than 5 mm, and forming a directed light line of respective width, corresponding to the extension of the CCD line. It is understood that shown light source 6 in practical applications is closed on both ends and is made black inside (with the exception of the optical elements). In the drawing the side covers have been omitted, for the sake of better understanding. The orientation of optical convergent lens 11 has been selected such that the optical axis of emission source 8 is generally co-linear with the optical axis of light exit opening 12 or coincides with the latter, respectively.

In this embodiment, determination of a coin diameter is generally made as already described above.

Basically, the CCD element may be adjusted, in its wavelength-dependent sensitivity properties, such that maximum sensitivity is obtained in the area of the emission spectrum of the light source, preferably at its maximum. For this purpose, suitable filters may be provided at the sides of the light source and/or the CCD element. The light source may also be operated in a(n) (amplitude)modulated mode, then the signal generated in the CCD element being processed with the modulation frequency for evaluation. In this way, foreign light interferences are minimized.

While specific embodiments of the invention have been shown and described in detail to illustrate the application of the principles of the invention, it will be understood that the invention may be embodied otherwise without departing from such principles.

What is claimed is:

1. A device for counting and/or sorting coins fed in a regular sequence, the device comprising:

a guiding track having a guiding edge, the track feeding the coins in an regular sequence with borders of the coins resting against the guiding edge; and a coin identification unit including an optical device for the determination of coin diameters, the optical device including a light source and a light-sensitive sensor opposite to coin, with respect to a main coin face, said sensor transforming irradiated light into electrical signals, said light-sensitive sensor including a CCD element, said light source comprising an emission source and optical elements for the generation of a light beam being directed in parallel and orthogonally to a main coin face, said optical elements including a parabolic mirror with a focus, said emission source is one of arranged at said focus point and imaged into said focus point, the lateral extension of the light beam and the arrangement of CCD element according to coin diameters to be detected being configured such that only a part only of the CCD element can be shaded by a coin to be detected.

2. A device according to claim 1, wherein said emission source is adapted as an LED.

3. A device according to claim 2, wherein said emission source emits in the wavelength range 640 to 980 mn.

4. A device according to claim 1, wherein a curvature of the parabolic mirror corresponds to a segment of a parabola leg.

5. A device according to claim 2, wherein a curvature of the parabolic mirror corresponds to a segment of a parabola leg.

6. A device according to claim 1, wherein the optical device includes a convergent lens and the light source is located in focus of the convergent lens or is imaged into focus of the convergent lens.

7. A device according to claim 2, wherein the optical device includes a convergent lens and the light source is located in focus of the convergent lens or is imaged into focus of the convergent lens.

8. A device according to claim 1, wherein the CCD element is a CCD line arranged orthogonally to the feeding direction, the extension line of said CCD line being arranged in a surface parallel to a main coin face, the optical system further comprising one of:

a parabolic mirror configured as a singly parabolically curved surface having, with respect to the curvature, a lateral extension of less than 10 mm and forming a directed light line of respective width, corresponding to the length extension of the an CCD line; or an optical convergent lens configured with singly curved surfaces having, with respect to the curvature, a lateral extension of less than 10 mm and forming a directed light line of respective width, corresponding to the length extension of CCD line.

9. A device according to claim 7, wherein said parabolic mirror configured as a singly parabolically curved surface has, with respect to the curvature, a lateral extension less than 5 mm.

10. A device according to claim 7, wherein said parabolic mirror configured as a singly parabolically curved surface has, with respect to the curvature, a lateral extension less than 3 mm.

11. A device according to claim 7, wherein said optical convergent lens has, with respect to the curvature, a lateral extension less than 5 mm.

12. A device according to claim 7, wherein said optical convergent lens has, with respect to the curvature, a lateral extension less than 3 mm.

13. A device according to claim 1, wherein the light source has a light exit opening with a bar lens provided in parallel to the light line, said bar lens reducing the width of the light line in the area of a coin to be detected.

14. A device according to claim 4, wherein in the immediate area of CCD line a stopping element for blocking the coin sequence is provided, said stopping element being adapted as a locking pin driven by a bi-stable magnet clearing the guiding track in one position of the magnet and blocking it in the other position of the magnet.

15. A device according to claim 1, further comprising: a deflection element provided behind coin identification unit for sorting-out coins of diameters different from the given diameter size, said deflection element being driven by means of a bi-stable magnet.

16. A method for determining coin diameters, the method comprising the steps of:

feeding coins in an irregular sequence on a guiding track, with their borders resting against a guiding edge through a coin identification unit having a CCD line, having an emission source radiating light in a plurality of different angular directions, and having optical elements focusing said light from said emission source into a parallel light beam and directing said light beam toward the coins in said track plane in a direction substantially perpendicular to a main coin face;

providing a multiple read out from the CCD line when a coin passes;

for every read-out process a shading degree is determined and a shading degree sequence for the individual coin is stored in a memory element, with reducing shading degree during passage of a coin the previously determined maximum shading degree being fetched from the memory element as a diameter size and being used as an input value of a sorting function.

17. A method according to claim 16, wherein the coin identification unit comprises:

a guiding track having a guiding edge, the track feeding the coins in an regular sequence with borders of the coins resting against the guiding edge; and a coin identification unit including an optical device for the determination of coin diameters, the optical device including a light source and a light-sensitive sensor opposite to coin, with respect to a main coin face, said sensor transforming irradiated light into electrical signals, said light-sensitive sensor including a CCD element, the lateral extension of the light beam and the arrangement of CCD element according to coin diameters to be detected being configured such that only a part only of the CCD element can be shaded by a coin to be detected.

18. A method according to claim 16, wherein the light source is switched to dark during the read-out cycle of the CCD line.

19. A device for identifying a coin, the device comprising:

a guiding track feeding the coin along a track plane;

an optical device arranged on one side of said track plane, said optical device including an emission source radiating light in a plurality of different angular directions, said optical device including an optical element for focusing said light from said emission source into a parallel light beam and directing said light beam toward the coin in said track plane in a direction substantially perpendicular to said track plane;

a light sensor arranged on another side of said track plane and including a CCD element receiving said light beam from said optical device, said CCD converting said light beam into an identification signal representing an amount of said light beam received by said CCD, said optical device, the coin and said CCD element being arranged to have the coin only partially block said light beam and cause said identification signal to represent a size of the coin.

20. A device in accordance with claim 19, wherein:

said optical element includes a parabolic mirror with a focus point;

said emission source is one of arranged at said focus point and imaged into said focus point.

* * * * *